US007800020B2

(12) United States Patent
Ceva

(10) Patent No.: US 7,800,020 B2
(45) Date of Patent: Sep. 21, 2010

(54) HEATING PLATE FOR HAIR STRAIGHTENING IRON AND ITS MANUFACTURING PROCESS

(76) Inventor: Carlos José Ceva, Avda Andrés Rolón 1107 - San Isidoro -, Buenos Aires (AR)

( * ) Notice: Subject to any disclaimer, the term of this patent is extended or adjusted under 35 U.S.C. 154(b) by 531 days.

(21) Appl. No.: 11/624,878

(22) Filed: Jan. 19, 2007

(65) Prior Publication Data

US 2008/0173630 A1 Jul. 24, 2008

(51) Int. Cl.
*A45D 1/04* (2006.01)
*A45D 1/00* (2006.01)

(52) U.S. Cl. ..... 219/222; 219/221; 219/223; 219/543; 219/544; 219/533; 219/552; 219/270; 132/269; 29/611

(58) Field of Classification Search ..... 219/221–3, 219/543–4, 533, 552, 270; 132/269; 29/611
See application file for complete search history.

(56) References Cited

U.S. PATENT DOCUMENTS 5,560,851 A * 10/1996 Thimm et al. ..... 219/543
2006/0228555 A1* 10/2006 Hata et al. ..... 428/409

* cited by examiner

*Primary Examiner*—Shawntina Fuqua
(74) *Attorney, Agent, or Firm*—Hughes Hubbard & Reed LLP

(57) ABSTRACT

A heating plate for a hair straightening iron and a method for its manufacture are provided. The heating plate consists of a case comprising two laminates made of insulating ceramic material; one of them holds a band made of electrical conductor material with outer connections, while one of the laminates has a surface coated with a polished layer of material; the case of the heating plate has features to adapt to the base structure of the iron. The manufacturing process comprises: 1) preparing a ceramic powder which comprises the milling of dispersants and adding solvents, mixing with a binding agent and adding plasticizer to control viscosity of the result, 2) moulding and corresponding drying; 3) cuffing plates and screen-printing the resistor; 4) laminating the whole by pressure and cutting; 5) burning the binding agent and sintering; and 6) welding contact terminals, and coating with a polished layer.

4 Claims, 2 Drawing Sheets

HEATING PLATE FOR HAIR STRAIGHTENING IRON AND ITS MANUFACTURING PROCESS

BACKGROUND OF THE INVENTION

1. Field of the Invention

The present invention relates generally to heating devices used for straightening hair, and it particularly refers to a heating plate included in hair straightening irons.

2. Description of Prior Art

As it is known, there are numerous applications which have been thought for the production of heating units equipped with a good electrical insulation, which ensure not only its safe handling but also the protection of the resistor from external agents.

In order to solve this problem, several solutions, based on protecting the electrical element, have been presented and submitted, such is the case of the ceramic resistors.

After a search, several productions have been found, among them, the following can be listed:

Patent WO 2006/081223, which relates to a "Method of manufacturing tin oxide-based ceramic resistors and obtained resistors". There, it is explained how different steps are followed in the process of forming antimony powder with a dose of tin oxide and mixed with a pulverulent vitrifiable compound, and making the resistor by thermal treatment.

U.S. Pat. No. 4,804,823 which consists in a "Ceramic heater". The heat generator is a resistor placed inside or over the surface of a ceramic holder, with terminals connected at both ends of the resistor. The ceramic substrate is made of certain nitrite selected from the group Si and Al, while the resistor is made of nitrite from Ti (TiN) and Tungsten Carbonate (WC).

U.S. Pat. No. 6,960,741 refers to a "Large area ceramic heater". It describes a disk as a collector burner aimed for cooking, which is provided by two bowed parts of alumina ceramic having opposed concave regions adhered together as a laminate, between which the electrical resistor is deposited.

There are also other patents which are manufactured in different ways or are made of different materials. There have been found no interferences with the present invention, among the above-mentioned examples and other similar ones.

BRIEF SUMMARY OF THE INVENTION

The present invention is intended to provide an effective construction that allows the almost instantaneous heating of the well-known hair straightening irons used at the hairdresser's salon for the conditioning of naturally curly hair.

Therefore, the invention has mainly been developed with a simple modular structure intended to be applied to the construction of hair straightening irons, and having characteristics which allow optimal usage conditions so that the required temperature is obtained in a very short time, in around 3 or 4 seconds, making the professional hairstylist's job easier by minimizing the waiting time for the iron to be ready to use.

A further advantage of the invention lies in the closeness between the surface of the resulting plate and the heating resistor, since the resistor is made a part of the case which has insulating characteristics for the electricity.

An additional advantage of the present invention is that, due to its special structure, it results a modular part which can easily be fitted in or removed from a device, in the event of having to change it.

Another purpose of the present document is to describe the manufacturing process of the plate-resistor which is the object of this invention.

The benefit of the described invention could be compared to an ordinary iron, which must have a heating resistor and a plain surface as plate. Both elements, resistor and plate, must be in close contact so as to transmit heat in a proper way, so that it is not partly dispersed by radiation within the space where it is housed. By using the same case for the two elements and their functions, basic economic benefits are obtained: in construction, since it is only one piece with a cost approximately equal to the one of a heating resistor while there is no cost for the plate; and in functioning, since it is not necessary to worry about the close contact required for the heat transmission, because the plate itself is the heater, which provides a remarkable improvement in the heating time.

In order to solve the above-mentioned problem in the easiest and most economical form, the preferred embodiment of the invention is summarized hereinafter. It consists of a case comprising two laminates made of insulating ceramic material; one of them holds a band made of electrical conductor material with outer connections, while one of the laminates has a surface coated with a polished layer of far-infrared radiation transmission material; said case has sliding lines around it which adapt to the base structure of the iron.

The preferred embodiment of the invention will be more clearly understood by reference to the following detailed description and attached drawings. Various modifications to the components will be readily apparent to those skilled in the art and the generic principles herein may be applied to other embodiments. Thus, the present invention is not intended to be limited to the embodiment shown but is to be accorded the widest scope consistent with the principles and features described herein.

BRIEF DESCRIPTION OF THE DRAWINGS

In the drawings attached to this description, the following is shown.

DETAILED DESCRIPTION OF THE INVENTION

Figure 1:
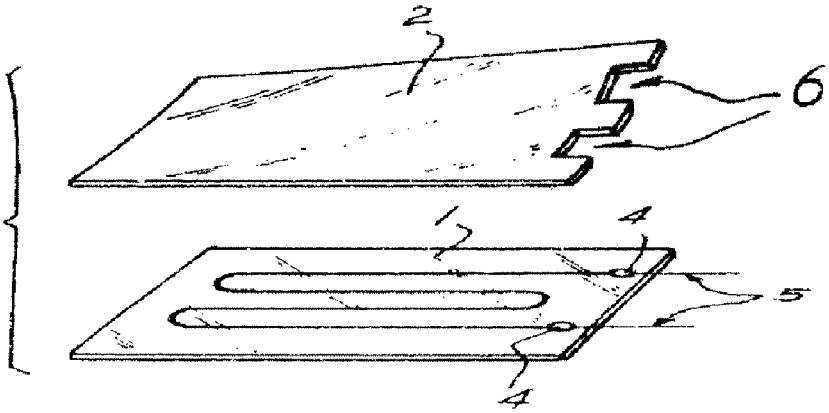
FIG. 1 illustrates a perspective view of the resistor included in the invention, which is seen in separate parts.
Figure 2:
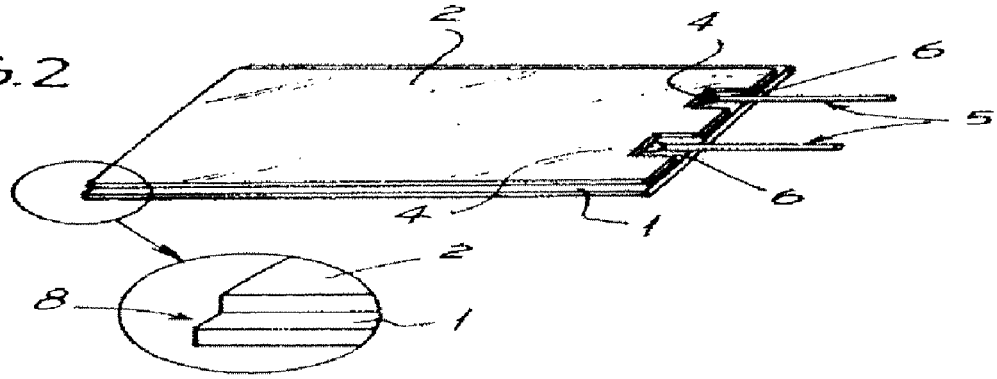
FIG. 2 is a perspective view illustrating the plate case according to the invention.
Figure 3:
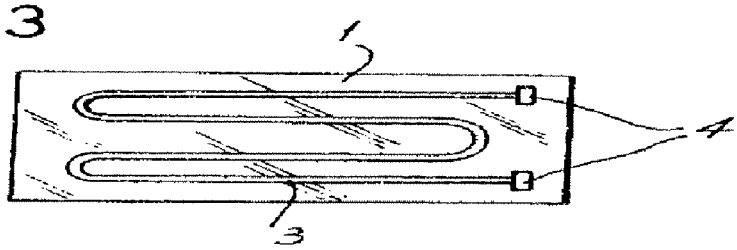
FIG. 3 is a bottom view illustrative of one of the plate layers in one of its manufacturing stages.

According to FIGS. 1, 2 and 3, once the layers 1 and 2 are prepared with electrical insulating ceramic material, during the first stage called "green layer", i.e. without the sintering thermal treatment, there follows the resistor construction, which is placed on the face opposite to the one in contact with the hair; this is done by means of the band 3, which is made of electric conducting material and has terminals 4 and connection wires at both ends.

The plate 2, as cover, has gaps 6 so as to allow the passage of the wires 5 which connect to the terminals 4, as shown in FIG. 2.

The outer face of the plate 1 can be finally coated with any proper method, e.g. glaze painting, with a layer 7 made of a material which emits far-infrared radiation, regarded as the most proper for the iron operation.

Figure 4:
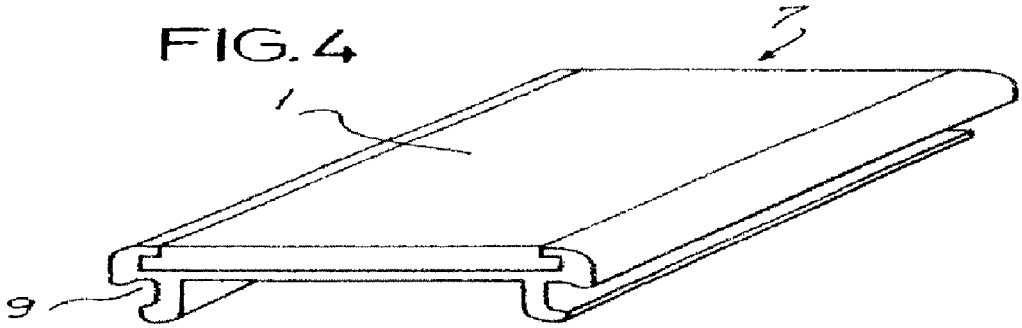
FIG. 4 is a perspective view illustrating the plate-holder assembly for the hair straightening iron Corresponding reference characters indicate corresponding parts throughout the several views.

FIG. 4 illustrates the ways of putting the plate and iron together; there could be several ways. This illustration shows that both plates have different widths, so the lateral edges form steps 8 aimed to match with similar lateral grooves which allow its fixing by sliding the heating plate through them.

The lateral edges of the plate can also have, among others, the form of a wedge, ending in a right angle, etc. or be fitted into a case 9 adapted to the iron, as illustrated in FIG. 4.

The manufacturing process is very simple and consists of the following stages:

1) Preparation of the ceramic powder which comprises the milling of dispersants and adding of solvents, the mixing with the binding agent and adding of plasticizer; a viscosity control of the result is made, and then 2) there follows the molding and corresponding drying; 3) the plates are cut and the resistor is screen printed; 4) the whole is laminated by pressure and then cut; after that, 5) the binding agent is burnt and a sintering is performed, finally, 6) the contact terminals are welded.

During the first stage, the mixture is prepared in liquid state in order to build the substrate layer of the resistor. Basically, the ceramic element used is alumina in powder with a PVC-type binding agent; some other element is conveniently added so as to get a good base. Once the optimum viscosity is controlled, the "green layer" is prepared in order to make the plates on which the band to form the resistor will be printed.

These plates are made by draining the fluid obtained through a calibrated throat, and pouring it over a plain surface; it dries there and the solvents are eliminated. Thus, a flexible layer is obtained, it is called "green layer" because it has not been thermally treated yet.

In the third stage, the resistors are conveniently apart printed on said layer, which will later be each plate 1; this is done by means of a process known as screen printing. Each resistor 3 is drawn by distributing a sort of ink that contains tungsten (the most convenient material to obtain a good resistor) over a mesh which defines the resistor circuit.

The fourth stage is the one in which the case for each of the plates is made. To that end, the previously obtained green layer is covered with a second green layer, as a sort of cap for each resistor. The whole is pressed by a special machine that also applies temperature in order to make the two layers be perfectly joined together; then, they are cut according to each module size.

The fifth stage consists in the process of eliminating the organic material which was incorporated while mixing the original material; it must be eliminated before the sintering, which is performed by means of a first heating at 350° C.

Once the above-mentioned process is done, the modules are sintered so as to obtain the required rigidity by means of a ceramic process. This thermal treatment is done at a temperature of 1580° C.

The process ends in the sixth stage when the wires 5 are welded to the terminals 4 of each resistor 3, by making use of the gaps 6 left in the plates 2.

Thus, each module consists of two "green layers", one of which carries the resistor while the other is placed over it as a cap. As they are closely joined by the sintering, they will constitute only one element with the resistor included as a part of one of the side layers, which could be coated with a material that channels the temperature produced by the resistor.

Operation

Once the different components of the invention have been explained, there follow further descriptions adding the functional and operational relation between its parts and its outcome.

The construction aspect of the heating plate is very simple, so there is no need of further details.

The manufacturing process clearly explains itself and is obtained by means of a circuit printed on an insulating layer, having two terminals to be connected to the hair straightening device.

It is worth mentioning that including the resistor inside the plate, located very close to one of its faces, optimizes the homogeneous distribution of heat along the plate surface and allows the necessary temperature in a very short time, making the professional hairstylist's job easier as well as saving time and energy.

The functional relation as regards the materials chosen is highly interesting, since it is based on the plate structure: the heating resistor is protected inside the insulating layers that form the plate, preventing the user from possible electric discharges and protecting it from environmental humidity as well as from mistreatment, which affect its practical duration.

Thus there has been described one of the possibilities of construction that lead to carry out the invention as well as the way it works, and also its specific application.

I claim:

1. Manufacturing process of a heating plate for a hair straightening iron, characterized in that it is developed following these stages: 1) Preparation of the ceramic powder which comprises the milling of dispersants and adding of solvents, the mixing with the binding agent and adding of plasticizer; a viscosity control of the result is made, and then 2) there follows the molding and corresponding drying; 3) the plates are cut and the resistor is screen printed; 4) the whole is laminated by pressure and then cut; 5) after that the binding agent is burnt and a sintering is performed; it is finished with 6) the welding of the contact terminals, and an eventual polished layer for coating purposes, further characterized in that during the first stage, the mixture is prepared in liquid state in order to build the substrate layer of the resistor, where the ceramic element used is alumina in powder with a PVC-type binding agent, some other element is conveniently added so as to get a good base, and once the optimum viscosity is controlled, the "green layer" (material without thermal treatment) is prepared in order to make the plates on which the band to form the resistor will be printed.

2. Manufacturing process of a heating plate for a hair straightening iron, characterized in that it is developed following these stages: 1) Preparation of the ceramic powder which comprises the milling of dispersants and adding of solvents, the mixing with the binding agent and adding of plasticizer; a viscosity control of the result is made, and then 2) there follows the molding and corresponding drying; 3) the plates are cut and the resistor is screen printed; 4) the whole is laminated by pressure and then cut; 5) after that the binding agent is burnt and a sintering is performed; it is finished with 6) the welding of the contact terminals, and an eventual polished layer for coating purposes, further characterized in that these plates are made by draining the fluid obtained through a calibrated throat, and pouring it over a plain surface; it dries there and the solvents are eliminated, and thus said flexible layer is obtained, it is called "green layer" because it has not been thermally treated yet.

3. Manufacturing process of a heating plate for a hair straightening iron, characterized in that it is developed following these stages: 1) Preparation of the ceramic powder which comprises the milling of dispersants and adding of solvents, the mixing with the binding agent and adding of plasticizer; a viscosity control of the result is made, and then 2) there follows the molding and corresponding drying; 3) the plates are cut and the resistor is screen printed; 4) the whole is laminated by pressure and then cut; 5) after that the binding agent is burnt and a sintering is performed; it is finished with 6) the welding of the contact terminals, and an eventual polished layer for coating, further characterized in that the fifth stage consists in the process of eliminating the organic material which was incorporated while mixing the original material, which is performed by means of a first heating at 350° C., after that the modules are sintered by means of a thermal treatment at a temperature of 1580° C.

4. Manufacturing process of a heating plate for a hair straightening iron, characterized in that it is developed following these stages: ) Preparation of the ceramic powder which comprises the milling of dispersants and adding of solvents, the mixing with the binding agent and adding of plasticizer; a viscosity control of the result is made, and then 2) there follows the molding and corresponding drying; 3) the plates are cut and the resistor is screen printed; 4) the whole is laminated by pressure and then cut; 5) after that the binding agent is burnt and a sintering is performed; it is finished with 6) the welding of the contact terminals, and an eventual polished layer for coating, further characterized in that in the sixth stage the wires are welded to the terminals of each resistor by making use of the gaps left in the plates.

* * * * *